US009140007B2

(12) United States Patent
Beaty et al.

(10) Patent No.: US 9,140,007 B2
(45) Date of Patent: Sep. 22, 2015

(54) RAIN SCREEN FRAMING SYSTEM

(71) Applicant: MOTO Extrusions, Inc., Capitola, CA (US)

(72) Inventors: Brent Beaty, Soquel, CA (US); Daniel Gomez, Aptos, CA (US); Daniel Townsend, Aptos, CA (US)

(73) Assignee: MOTO Extrusions, Inc., Capitola, CA (US)

( * ) Notice: Subject to any disclaimer, the term of this patent is extended or adjusted under 35 U.S.C. 154(b) by 0 days.

(21) Appl. No.: 14/260,248

(22) Filed: Apr. 23, 2014

(65) Prior Publication Data

US 2014/0311064 A1 Oct. 23, 2014

Related U.S. Application Data

(60) Provisional application No. 61/854,368, filed on Apr. 23, 2013.

(51) Int. Cl.

| | |
|---|---|
| ***E04C 2/00*** | (2006.01) |
| ***E04B 2/02*** | (2006.01) |
| ***E04B 2/16*** | (2006.01) |
| ***E06B 1/34*** | (2006.01) |
| ***E06B 1/36*** | (2006.01) |
| ***E04F 13/08*** | (2006.01) |
| *E06B 1/68* | (2006.01) |

(52) U.S. Cl.

CPC ... *E04B 2/02* (2013.01); *E04B 2/16* (2013.01); *E04F 13/0817* (2013.01); *E06B 1/34* (2013.01); *E06B 1/36* (2013.01); *E04B 2002/0256* (2013.01); *E06B 1/68* (2013.01)

(58) Field of Classification Search

CPC ..... E04B 2/96; E04B 3/5417; E04B 2/88; E04B 2/02; E04B 2/16; E04B 1/34

USPC ..... 52/235, 483, 287.1, 288.1, 716.1, 52/716.4, 717.01, 718.01, 717.06, 204.5, 52/204.53, 205.55, 204.591, 204.593, 52/204.6, 474, 302.1, 302.3, 506.05, 52/506.06, 656.4, 656.5, 653.2

See application file for complete search history.

(56) References Cited

U.S. PATENT DOCUMENTS

| | | | | |
|---|---|---|---|---|
| 2,803,858 | A * | 8/1957 | Rader | 52/464 |
| 3,421,281 | A * | 1/1969 | Harris | 52/483.1 |
| 3,534,516 | A * | 10/1970 | Cooper | 52/481.2 |
| 3,956,861 | A * | 5/1976 | Rasmussen | 52/288.1 |
| 3,998,016 | A | 12/1976 | Ting | |
| 4,910,938 | A * | 3/1990 | McGee | 52/481.2 |
| 4,999,961 | A * | 3/1991 | McNary | 52/287.1 |

(Continued)

OTHER PUBLICATIONS

Eurofox Facade Technology, A structured approach to facades, brochure, Ed. 2007, 52 pp., Lanzenkirchen, Austria.

(Continued)

*Primary Examiner* — Beth Stephan

(74) *Attorney, Agent, or Firm* — John G. Fischer, Esq.; Jaspal S. Hare, Esq.; Scheef & Stone, L.L.P.

(57) ABSTRACT

The present invention provides a universal framing system for securing cladding to the interior or exterior of a structure. The framing system comprises hat channels, face plates, Z-channels, inside corner trims, outside corner trims, and window trims. The components of the framing system are secured to a wall of a structure, then panels of cladding are secured to the components.

18 Claims, 13 Drawing Sheets

(56) References Cited

U.S. PATENT DOCUMENTS

| | | | | |
|---|---|---|---|---|
| 5,065,557 | A * | 11/1991 | Laplante et al. | 52/235 |
| 5,220,759 | A * | 6/1993 | Hossli | 52/235 |
| 5,222,343 | A * | 6/1993 | Anderson | 52/718.04 |
| 5,542,222 | A * | 8/1996 | Wilson et al. | 52/287.1 |
| 5,678,383 | A * | 10/1997 | Danielewicz | 52/775 |
| 5,687,524 | A * | 11/1997 | Ting | 52/461 |
| 5,893,245 | A * | 4/1999 | Sekiguchi et al. | 52/235 |
| 5,974,748 | A * | 11/1999 | Sciuga et al. | 52/287.1 |
| 6,226,947 | B1 * | 5/2001 | Bado et al. | 52/483.1 |
| 6,553,732 | B2 * | 4/2003 | Shaw | 52/287.1 |
| 6,988,344 | B1 * | 1/2006 | Krueger | 52/464 |
| 7,191,570 | B1 * | 3/2007 | Eaton | 52/506.09 |
| 8,033,066 | B2 * | 10/2011 | Griffiths | 52/235 |
| D662,805 | S | 7/2012 | Macdonald et al. | |
| 8,336,273 | B2 * | 12/2012 | Enns | 52/588.1 |
| 8,429,866 | B2 | 4/2013 | Knight et al. | |
| 8,769,901 | B2 | 7/2014 | Todd et al. | |
| 2004/0074175 | A1 * | 4/2004 | Tierney | 52/255 |
| 2005/0060950 | A1 * | 3/2005 | Hauschildt et al. | 52/235 |
| 2005/0262782 | A1 * | 12/2005 | Harrison et al. | 52/204.53 |
| 2006/0143996 | A1 * | 7/2006 | Alvarado | 52/204.53 |
| 2009/0272060 | A1 * | 11/2009 | Lucchesi | 52/489.1 |
| 2010/0031597 | A1 | 2/2010 | Baek | |
| 2010/0199585 | A1 | 8/2010 | Stevens et al. | |
| 2010/0229484 | A1 * | 9/2010 | Carolan et al. | 52/302.1 |
| 2010/0251647 | A1 * | 10/2010 | Enns | 52/302.1 |
| 2012/0137610 | A1 | 6/2012 | Knight et al. | |
| 2012/0174503 | A1 | 7/2012 | Milostic | |
| 2012/0297725 | A1 | 11/2012 | Anastasi | |
| 2012/0317909 | A1 | 12/2012 | MacKenzie | |
| 2013/0291465 | A1 | 11/2013 | Resso | |
| 2014/0026510 | A1 | 1/2014 | Kubassek et al. | |

OTHER PUBLICATIONS

Knight Wall Systems, Inc., Code Compliant Continuously Insulated Exterior Wall Assembly: Thermal & Air Barrier Wall System With a Rain Screen Attachment System (vertical members only) for Exterior Siding or Cladding Panels, Performance Guide Specification, Jun. 19, 2013, 18 pp., Deer Park, WA.

Knight Wall Systems, Inc., Code Compliant Continuously Insulated Exterior Wall Assembly: Thermal & Air Barrier Wall System With a Rain Screen Attachment System (vertical+horizontals) for Exterior Siding or Cladding Panels, Performance Guide Specification, Jun. 19, 2013, 18 pp., Deer Park, WA.

Dow—Knight Wall Systems, Inc. CI-System Face Fastened Panels Thermax™ Wall System Guide Detail, May 25, 2012, 18 pp., Deer Park, WA.

Dow—Knight Wall Systems, Inc., CI-System (CI-SidingRail) with Fiber Cement Lap Siding Thermax™ Wall System Guide Detail, Jun. 27, 2012, 9 pp., Deer Park, WA.

Dow—Knight Wall Systems, Inc., CI-System (CI-SidingRail) D.A. F.S on Cement Board Thermax™ Wall System Guide Detail, Jun. 27, 2012, 16 pp., Deer Park, WA.

Knight Wall Systems, Inc., Knight CI-System Rain Screen Attachment (vertical members only) Assembly Requirements & Guide Details, Jul. 31, 2013, 18 pp., Deer Park, WA.

Knight Wall Systems, Inc., Knight CI-System Rain Screen Attachment (vertical+horizontal members) Assembly Requirements & Guide Details, Jul. 31, 2013, 18 pp., Deer Park, WA.

Nelson, Brian, Panel Attachment & The Energy Code: How to Meet & Exceed the Energy Code With Exterior Mineral Fiber Insulation, white paper, Jul. 2013, 3 pp., Knight Wall Systems, Inc., Deer Park, WA.

Dow—Knight Wall Systems, Inc., CI-System for ASHRAE Compliant Continuous Insulation: R-Value = Real Value, Internet printout, May 1, 2014, 1 pg., Deer Park, WA.

Northclad Rainscreen Solutions, The AL Series details, Internet printout, 2009, 21 pp., Everett, WA.

Northclad Rainscreen Solutions, The EF Series details, Internet printout, 2009, 19 pp., Everett, WA.

American Fiber Cement Corp., Architectural Panels, Installation Guidelines, Aluminum Profiles with Rivets, Jun. 2011, 8 pp., Littleton, CO.

Allface Befestigungstechnologie GmbH & CoKG, Smart Fixing Systems, brochure, Feb. 2011, 16 pp., Leobersdorf, Austria.

Allface Befestigungstechnologie GmbH & CoKG, Smart Fixing Systems, company brochure, Nov. 2006, 4 pp., Leobersdorf, Austria.

Allface Befestigungstechnologie GmbH & CoKG, System Specifications, Apr. 2014, 28 pp., Leobersdorf, Austria.

Allface Befestigungstechnologie GmbH & CoKG, Smart Fixing Systems, Projekt-Info, Apr. 2014, 1 p., Leobersdorf, Austria.

Allface Befestigungstechnologie GmbH & CoKG, Systems Thinking, brochure, Sep. 2008, 8 pp., Leobersdorf, Austria.

Eurofox Facade Technology, brochure, Jul. 2011, 88 pp., Lanzenkirchen, Austria.

Eurofox Facade Technology, HILTI, FLA-h-100, Aluminum Support System for Rainscreen Cladding System for the Visible Attachment Fixed by Rivets, brochure, Jun. 2012, 21 pp., Lanzenkirchen, Austria.

Dow-Knight Wall Systems, Inc., CI-System and LEED, brochure, May 2011, 4 pp., Deer Park, WA.

Dow-Knight Wall Systems, Inc., CI-System Installation Procedures, May 2014, brochure, 6 pp., Deer Park, WA.

Dow-Knight Wall Systems, Inc., CI-System for ASHRAE-Compliant Continuous Insulation: R-Value Equals Real Value, brochure, Jul. 2012, 2 pp., Deer Park, WA.

Northclad Rainscreen Solutions, AL Series Aluminum Panel System, installation notes, Internet printout, 2009, 5 pp., Everett, WA.

Northclad Rainscreen Solutions, Go Modular with NorthClad Rectangular Aluminum Panel System, Internet printout, 2009, 2 pp., Everett, WA.

* cited by examiner

RAIN SCREEN FRAMING SYSTEM

This application claims the benefit of U.S. Provisional Application No. 61/854,368, filed Apr. 23, 2013.

TECHNICAL FIELD

The present invention generally relates to a framing system for cladding the exterior or interior of a structure.

BACKGROUND

Cladding the exterior and interior of residential and commercial buildings is gaining popularity. Exterior cladding may include a rain screen to protect the interior elements. Installation of cladding requires a framing system mounted to typically a wall of a structure, but may also be mounted to a roof, soffit, ceiling, floor, etc. The cladding is attached to the framing system. The framing system is typically made from galvanized metal. However, galvanized metal has many drawbacks.

One disadvantage is that galvanized metal cannot be used in coastal areas or areas of high moisture as the galvanized coating is insufficient to resist corrosion in these regions. Another disadvantage is that galvanized metal is difficult to cut and drill, which increases the cost and quality of the installation. Another disadvantage is that galvanized metal parts very rarely true, which requires additional labor to level components. Another disadvantage is that galvanized metal parts should be resealed after cutting or drilling to restitute the removed surface coating. Another disadvantage of conventional framing systems is that they normally provide a single-type of framing element, which must be cut and positioned to fit the geometric differences of the several structures and features (e.g., windows, doors, soffits, and corners) found on modern buildings. This one size fits all approach has proven inadequate and further increases the difficulty and cost of installation.

Another disadvantage of conventional cladding is that it fails to position the frames of the windows flush with the cladding. Windows are not normally perfectly aligned. When conventional cladding is applied, the misalignment of windows is magnified and more noticeable and thus aesthetically unpleasing. Often the window frame has a different offset than the cladding, which is also aesthetically unpleasing.

As such, there is a need for a framing system that has a greater resistance to corrosion, is simple and efficient to install, and adaptable to many different buildings and structural features. The system needs to be able to enhance the aesthetic appearance, especially of windows. Still further, there is a need for a framing system that has these advantages and is capable of being manufactured cost effectively and from low cost materials.

SUMMARY

The present invention provides a universal framing system for securing cladding to the interior or exterior of a structure. The present invention also provides cooperative window framing that improves alignment of installed windows with the cladding.

In an embodiment of the present invention, a sub-framing wall system for supporting cladding attached to a wall is provide, the sub-framing system comprising a hat channel having an elongated planar base, a pair of side walls extending upward from the base, and a latch extending inward from each side wall. A cap seat extends above each latch and outward of each side wall. First and second flanges extend outward from each cap seat. The hat channel is secured to a wall panel by fasteners extending through the base.

A face plate is provided having an elongated, planar body with an interior and opposite exterior surface. A pair of opposing side legs extends downward from the interior surface of the body. A strike ridge extends outward from each side leg. The strike ridges engage the latches of the hat channel to secure the face plate in compression against the cap seat of the hat channel. This provides a metal seal over the fasteners that penetrate the hat channel. A first panel of cladding is secured to the first flange. A second panel of cladding is secured to the second flange adjacent to the first panel such that the adjacent edges of the first and second panels are positioned over the face plate. This provides a solid backing to the junction between the exterior cladding sections. In another embodiment, the hat channel and face plate are made of extruded aluminum, such as 11 gauge 6000 series extruded aluminum.

In another embodiment, an interior corner trim is provided comprising a first wall and a second wall perpendicular to the first wall, forming an L-channel. A first flange is coupled to the first wall, parallel to, and offset from, the first wall. A second flange is coupled to the second wall, parallel to, and offset from, the second wall. The first and second flanges are offset outwardly from the L-channel.

In another embodiment, an exterior corner trim is provided, comprising a first wall and a second wall perpendicular to the first wall to form an L-channel. A first flange is coupled to the first wall, parallel to, and offset from, the first wall. A second flange is coupled to the second wall, parallel to, and offset from, the second wall. The first and second flanges are offset inwardly from the L-channel.

In another embodiment, a Z-channel is provided, comprising a flat central wall having a first flange extending outwards and perpendicular from one edge. A second flange extends outwards perpendicular from the opposite edge. The Z-channel may by positioned beneath and perpendicular to the hat channel, and may also be used to cover edges of the wall.

In another embodiment, a window trim element is provided, comprising an elongated body having a generally rectangular cross section. The body has a wall-facing surface and an opposite exterior-facing surface. The body also has a frame-facing surface perpendicular to the wall-facing and exterior-facing surfaces. The body also has a cladding-facing surface opposite the frame-facing surface. A pair of legs extends from the wall-facing surface to define a channel. A longitudinal cavity is formed in the body. A flange extends outward from the cladding-facing surface of the body, parallel to, and offset from the wall-facing and exterior-facing surfaces.

In another embodiment, the longitudinal cavity has a rectangular portion, and a circular portion on opposite ends of the rectangular portion. A beveled portion connects each circular portion with an end of the rectangular portion. The circular portions are receivable of fasteners to connect perpendicular sections of the window trim elements together.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. Additionally, as used herein, the term "substantially" is to be construed as a term of approximation.

Figure 1:
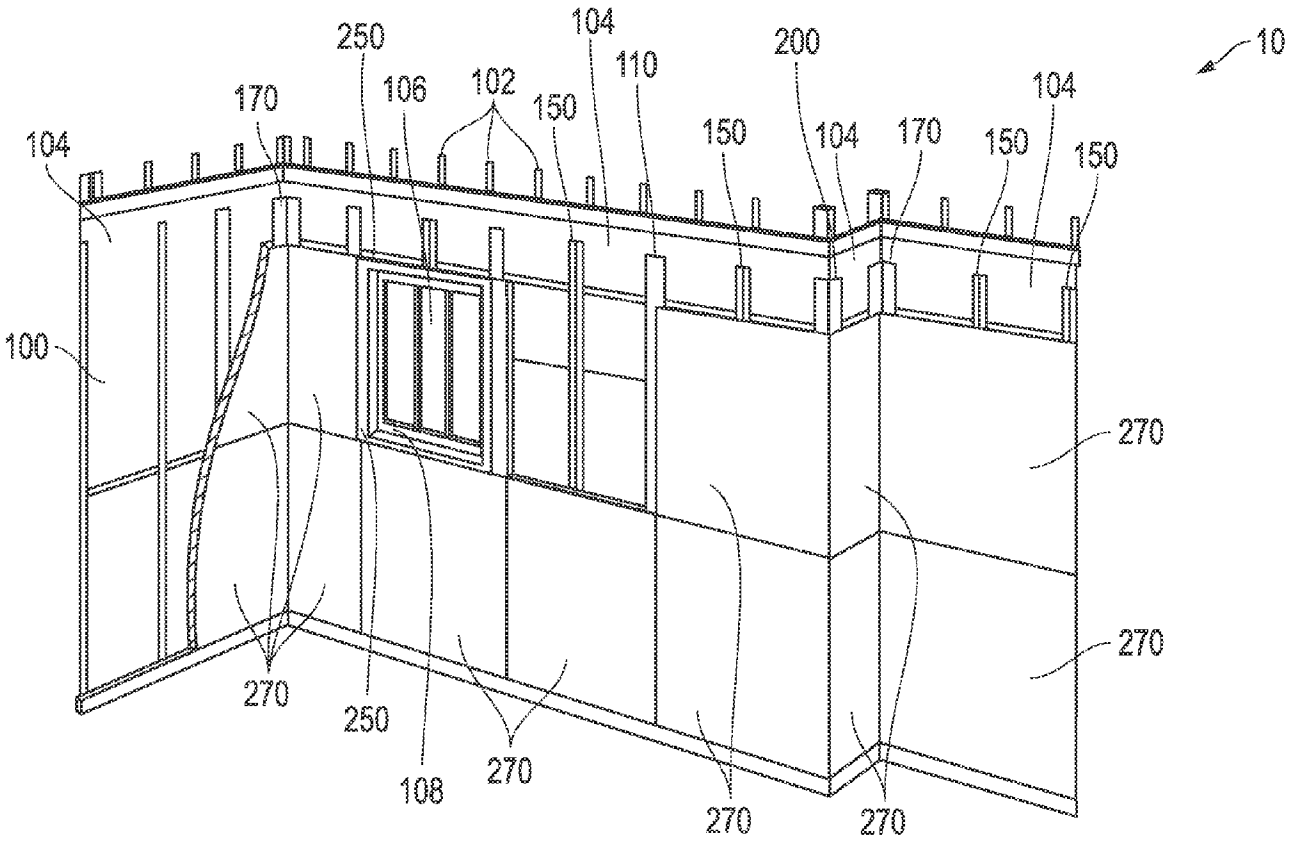
FIG. 1 is an isometric, partial-cutaway view of a structural wall embodying the sub-framing system in accordance with the present invention.

Referring to FIG. 1, a sub-framing system 10 is exemplified as installed on a wall 100 of a structure comprising studs 102 (not all shown are labeled) that are covered by sheathing 104 or boarding, dry wall or plaster board, etc. Sub-framing system 10 comprises hat channels 110, face plates 130 (not shown), Z-channels 150, inside corner trims 170, outside corner trims 200, and window trims 220 (not shown) that are assembled into trim-frame assembly 250. The parts of sub-framing system 10 are preferably made of 11 gauge 6000 series extruded aluminum. Each hat channel 110 is arranged vertically and secured to wall 100 preferably using self-tapping screws. Face plates 130 (not shown) are snapped into each hat channel 110. Z-channels 150 are also arranged vertically and secured to wall 100 preferably using self-tapping screws. Inside corner trims 170 are arranged vertically and secured to the inside corners of wall 100 preferably using self-tapping screws. Outside corner trim 200 is arranged vertically and similarly secured to the outside corner of wall 100. Trim-frame assembly 250 is placed around frame 108 of window 106. Panels of cladding 270 are then secured to hat channels 110, Z-channels 150, inside corner trims 170, and outside corner trim 200 preferably using rivets. Sub-framing system 10 may be used on the exterior of a building (i.e., as a rain screen) or the interior of a building.

Figure 2:
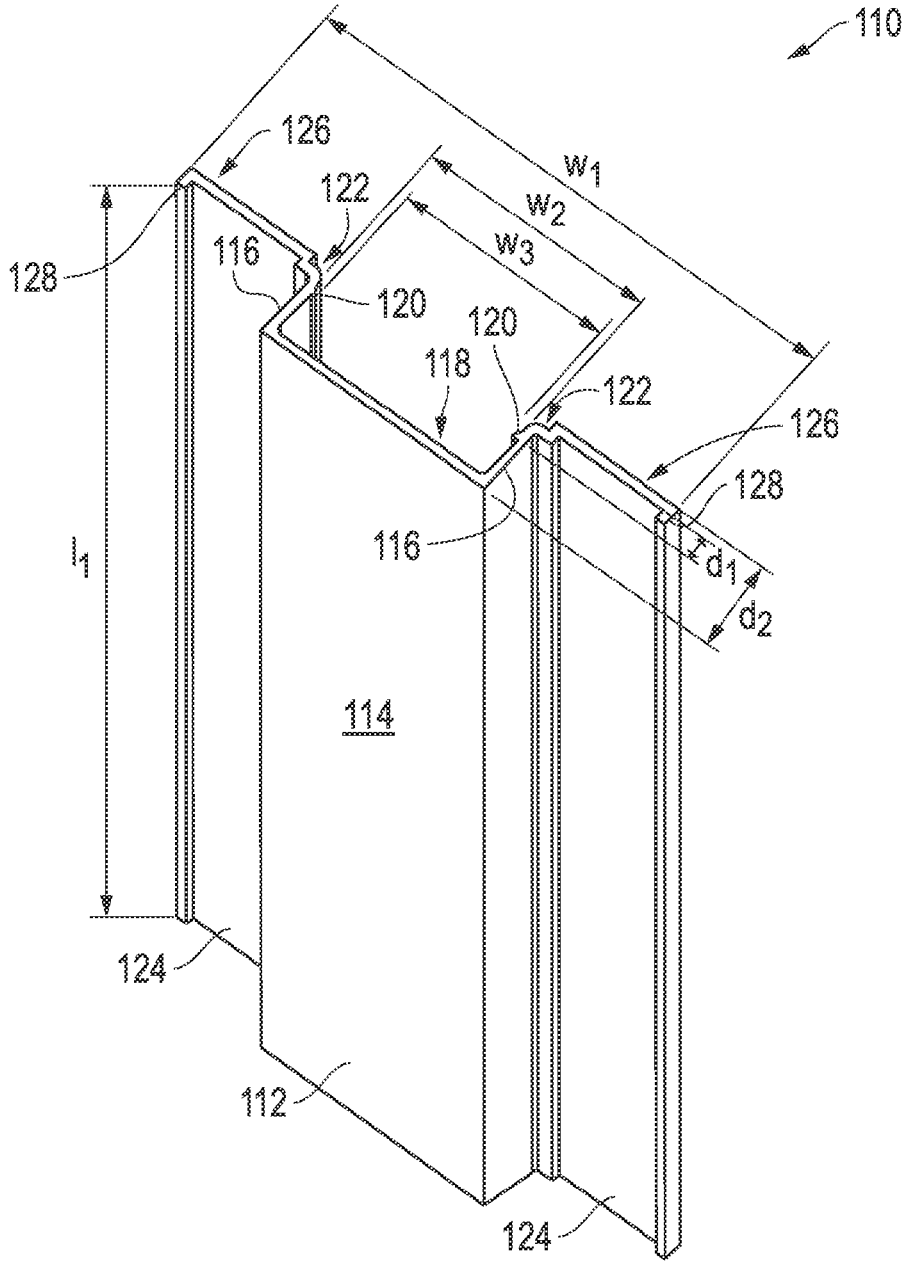
FIG. 2 is an isometric view of a hat channel.

Referring to FIG. 2, an isometric view of hat channel 110 is provided. Hat channel 110 comprises an elongated, planar base 112 and a pair of side walls 116 perpendicularly coupled to the ends of base 112. Base 112 has a width of $w_2$, which is preferably 2.5 inches. Base 112 has a wall-facing surface 114 for securing hat channel 110 to a wall using a fastener. Side walls 116 are parallel to one another and perpendicular to base 112. A U-shaped channel 118 is defined by the base 112 and side walls 116. Latches 120 are formed on the interior-sides of side walls 116 and protrude into U-shaped channel 118. Latches 120 extend longitudinally the length of U-shaped channel 118 and are offset from the end of the side walls 116 by a depth of $d_1$, which is preferably 0.227 inches. Cap seats 122 extend above each latch 120 and outward of each side wall 116. Cap seats 122 provide a seat for face plate 130 (not shown), which secures to latches 120. A pair of flanges 124 is coupled to the cap seats 122 and extends outwards. Flanges 124 have cladding-facing surfaces 126 opposite to the wall-facing surface 114 for securing one or more panels of cladding to hat channel 110. Flanges 124 are offset from the ends of the side walls 116 by cap seats 122. Curls 128 are formed at the distal ends of flanges 124. Hat channel 110 has an overall width of $w_1$, a depth of $d_2$, and a length of $l_1$. Preferably, $w_1$ is 5.438 inches and $d_2$ is 0.875 inches. Preferably, hat channel 110 is manufactured to have a length $l_1$ of 20 feet and may be cut to a desired length during installation.

Figure 3:
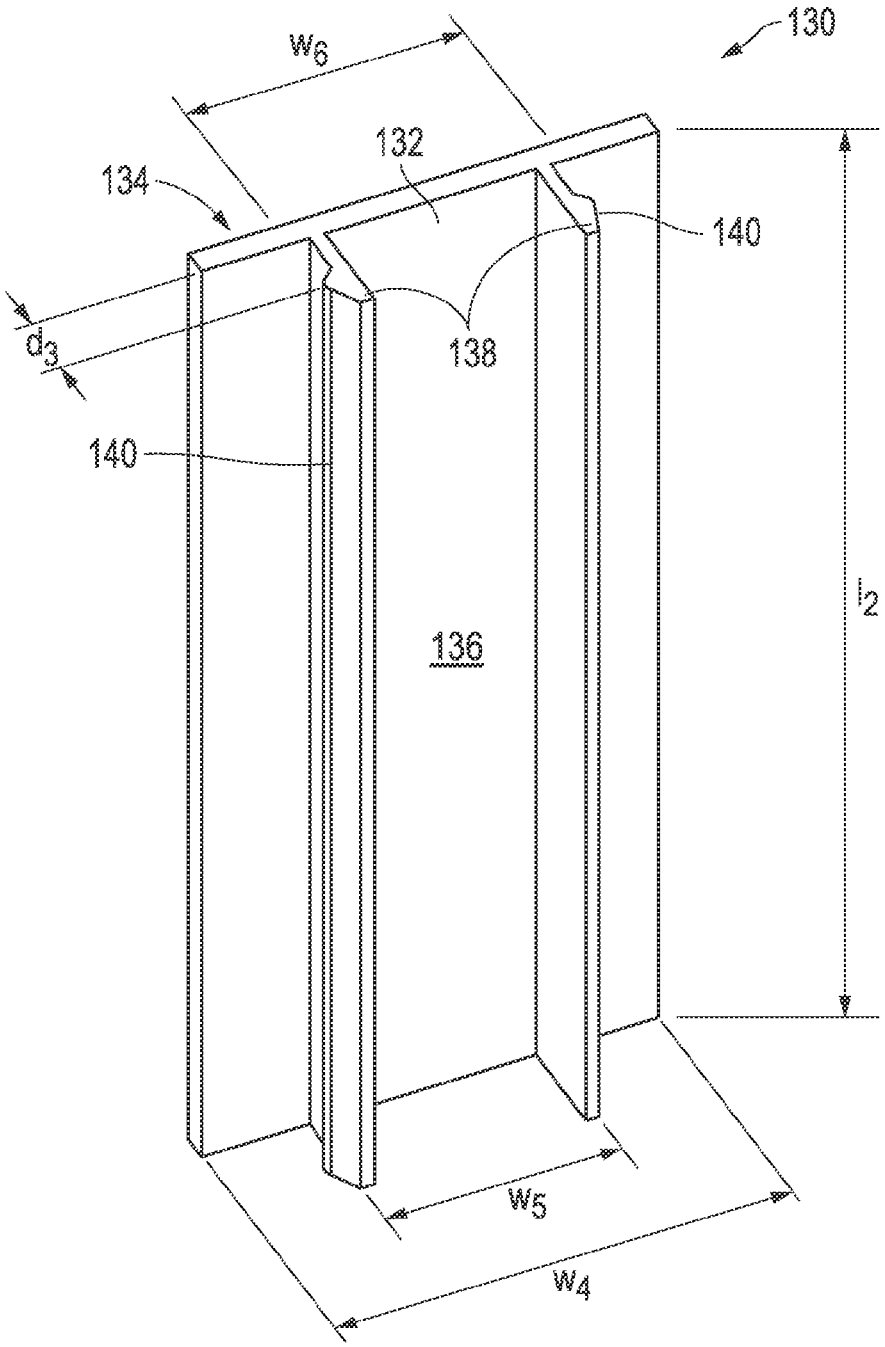
FIG. 3 is an isometric view of a face plate.

Referring to FIG. 3, an isometric view of face plate 130 is provided. Face plate 130 comprises an elongated, planar body 132 having a rectangular cross section. Body 132 has a width of $w_4$, which is preferably 2.688 inches. Body 132 has an exterior surface 134 and an opposite, interior surface 136. A pair of parallel, opposing side legs 138 protrudes downward from the interior surface 136 of body 132 and extends longitudinally along the interior surface 136. Side legs 138 are separated by a channel having a width of $w_5$, which is preferably 2.267 inches. Strike ridges 140 extend outward of each side leg 138. Strike ridges 140 are offset from the body 132 by a depth of $d_3$, which is preferably 0.227 inches. Width $w_6$ spans between the outermost points of strike ridges 140. Strike ridges 140 engage latches 120 of a hat channel 110 (not shown), which allow face plate 130 to be snapped into hat channel 110. Relief radiuses 133 (FIG. 4A) are located on each outside corner formed between each side leg 138 and body 132. Relief radiuses 133 are advantageous because they allow side legs 138 to deform inwards when face plate 130 is snapped into hat channel 110. Preferably, face plate 130 is manufactured to have a length $l_2$ of 20 feet and may be cut to a desired length during installation.

Figure 4:
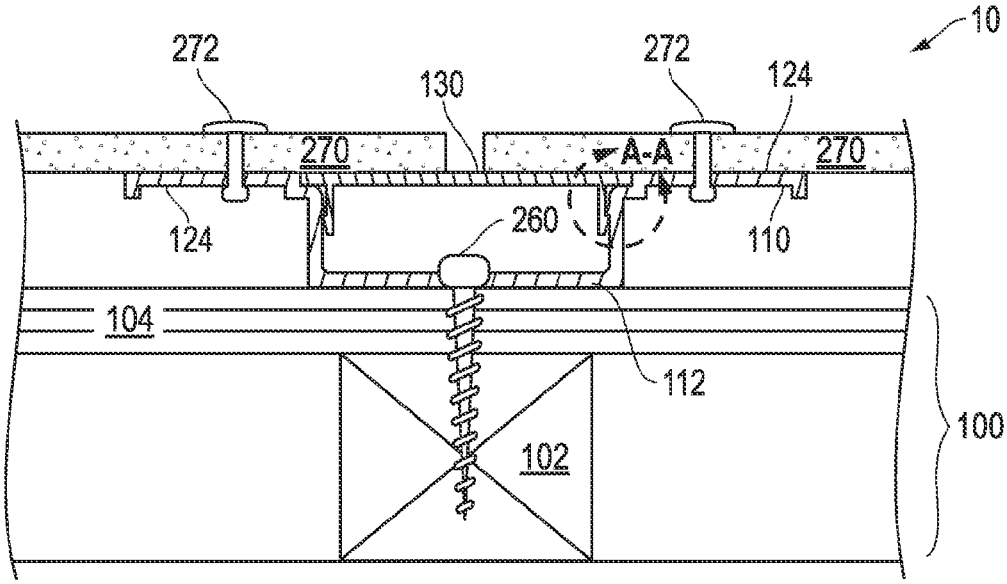
FIG. 4 is a cross-sectional, plan view of the hat channel and the face plate exemplified as installed in a structural wall.
Figure 4A:
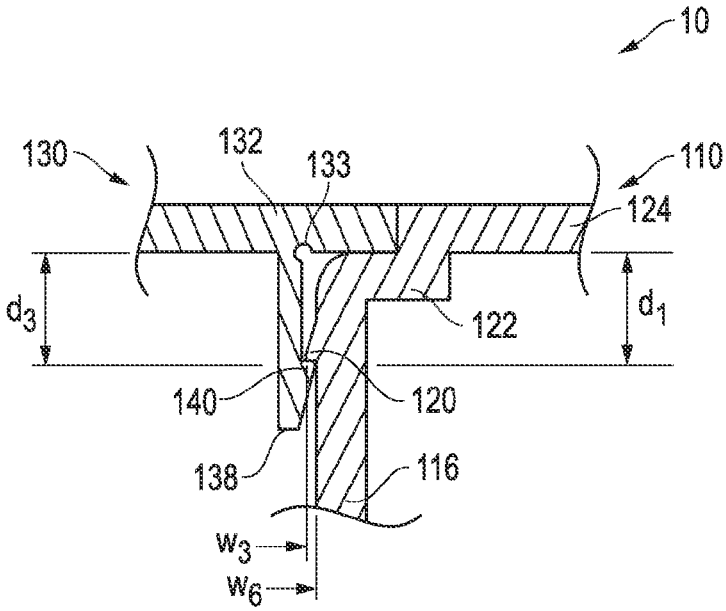
FIG. 4A is a close-up view of the hat channel and the face plate taken along view line A-A.

Referring to FIGS. 4 and 4A, hat channel 110 and face plate 130 are exemplified securing panels of cladding 270 to a structural wall 100. Wall 100 comprises stud 102 to which sheathing 104 is secured. Optionally, a water resistant barrier (not shown) may be applied to the exterior surface of sheathing 104. Hat channel 110 is aligned vertically such that the wall-facing surface 114 (not shown) faces stud 102 and is fastened using a fastener 260 that penetrates base 112, which is preferably a self-tapping screw. Optionally, face plate 130 is "snapped" into hat channel 110, thereby presenting a smooth face for installing paneling 270 and protecting fastener 260 from the external environment. When face plate 130 is snapped in, strike ridges 140 of face plate 130 engage latches 120 of hat channel 110 to secure face plate 130 (more particularly body 132) in compression against cap seats 122. Panels of cladding 270 are then secured to the cladding-facing surfaces 126 (not shown) of flanges 124 preferably using fasteners 272, which are preferably rivets. Hat channel 110 is particularly advantageous for securing joints where two panels of cladding come together. However, hat channel 110 may also secure a single panel of cladding (not shown). Alternatively when securing a single panel of cladding, hat channel 110 may be reversed, i.e., the cladding-facing surfaces face the wall while the wall-facing surface is used to secure the panel of cladding (not shown).

Figure 5:
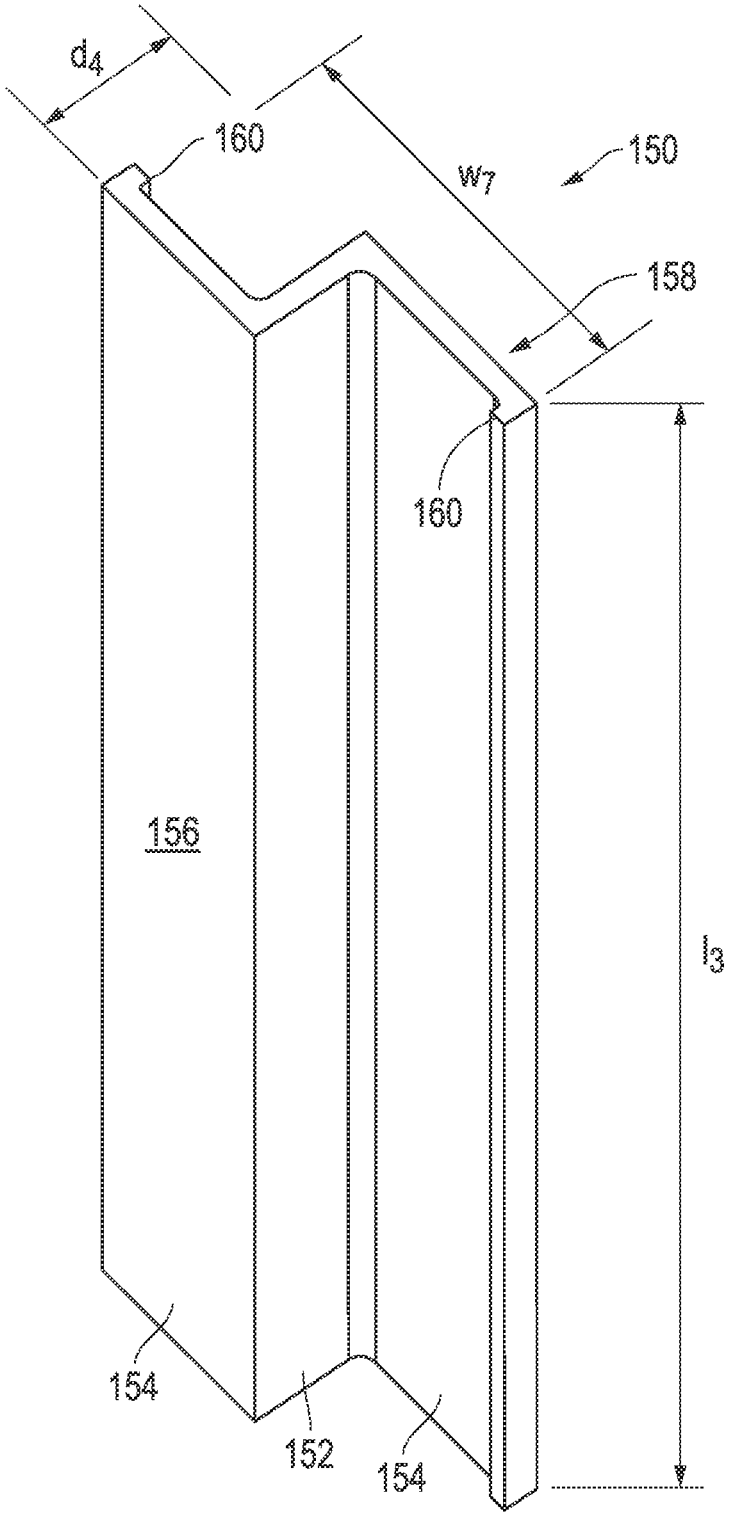
FIG. 5 is an isometric view of a Z-channel.

Referring to FIG. 5, an isometric view of Z-channel 150 is provided. Z-channel 150 comprises a central wall 152 having a pair of flanges 154 extending perpendicularly outward from central wall 152. The pair of flanges 154 is parallel and offset from one another by a depth of $d_4$. Offset $d_4$ is preferably 0.875 inches. Curls 160 are formed at the ends of each flange 154. Z-channel 150 has a cladding-facing surface 158 to which a panel of cladding may be secured and a wall-facing surface 156 used to secure Z-channel 150 to a structural wall. Z-channel 150 has a width of $w_7$, which is preferably 2.875 inches. Z-channel 150 has a length of $l_3$. Preferably, Z-channel 150 is manufactured to have a length of 20 feet and may be cut to a desired length during installation.

Figure 6:
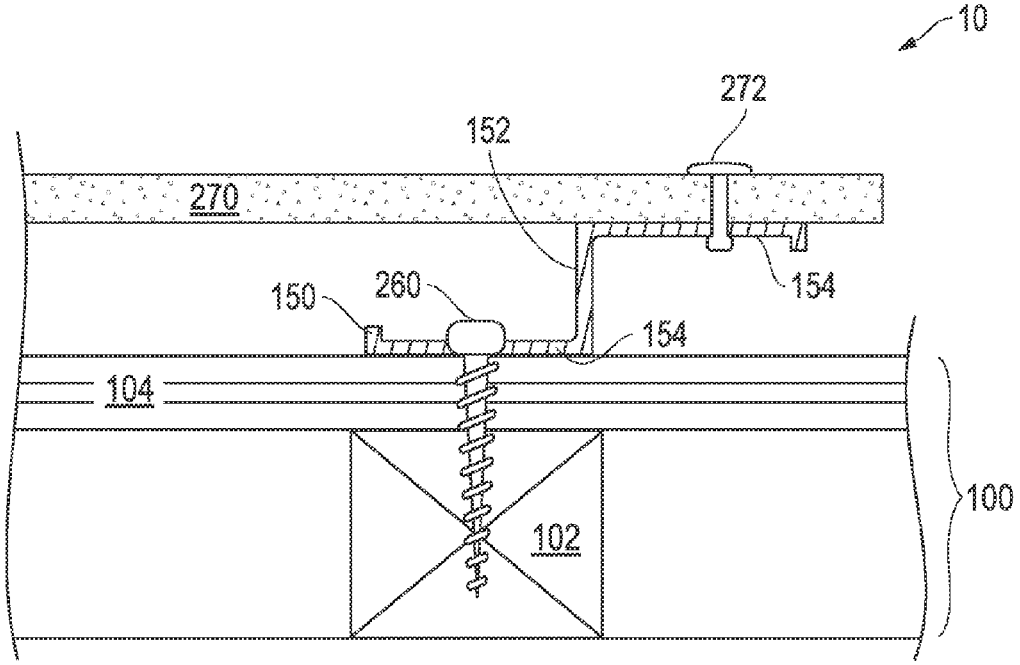
FIG. 6 is a cross-sectional, plan view of the Z-channel exemplified as installed in a structural wall.

Referring to FIG. 6, Z-channel 150 is exemplified securing a panel of cladding 270 to a structural wall 100. Wall 100 comprises stud 102 to which sheathing 104 is secured. Optionally, a water resistant barrier (not shown) may be applied to the exterior surface of sheathing 104. Z-channel 150 is aligned vertically such that the wall-facing surface 156 (not shown) faces stud 102 and is then preferably secured using fastener 260, which is preferably a self-tapping screw. A panel of cladding 270 is then secured to the cladding-facing surface 158 (not shown) preferably using fasteners 272, which are preferably rivets. Z-channels are particularly advantageous for securing an end or central portion of a single panel of cladding 270 (see also FIG. 1).

Figure 7:
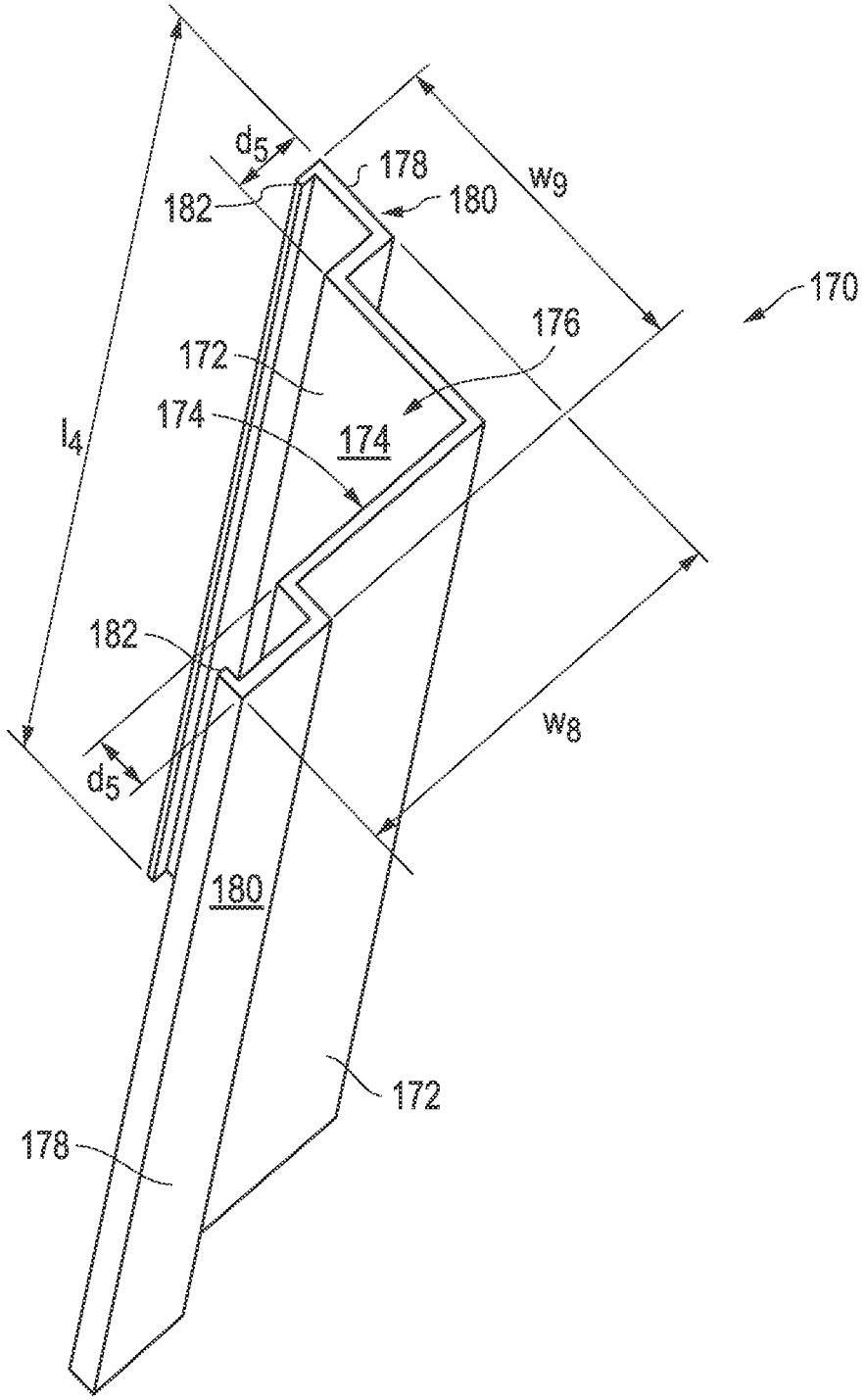
FIG. 7 is an isometric view of an inside corner trim.

Referring to FIG. 7, an isometric view of inside corner trim 170 is provided. Inside corner trim 170 comprises a pair of elongated walls 172 that are perpendicular to one another and form an L-channel 176. Each wall 172 has a cladding-facing surface 174 to which a panel of cladding may be secured. Flanges 178 are coupled to the ends of walls 172. Each flange 178 is parallel to and offset outwards away from the L-shaped channel 176 by an amount $d_5$ from its respective wall 172. Offset $d_5$ is preferably 0.875 inches. Curls 182 are formed at the ends of each flange 178. Each flange 178 has a wall-facing surface 180 for securing inside corner trim 170 to a structural wall. Inside corner trim 170 has widths of $w_8$ and $w_9$, which are preferably 4.75 inches. Inside corner trim 170 is preferably symmetrical, but need not be. Inside corner trim 170 has a length of $l_4$. Preferably, inside corner trim 170 is manufactured to have a length of 20 feet and may be cut to a desired length during installation.

Figure 8:
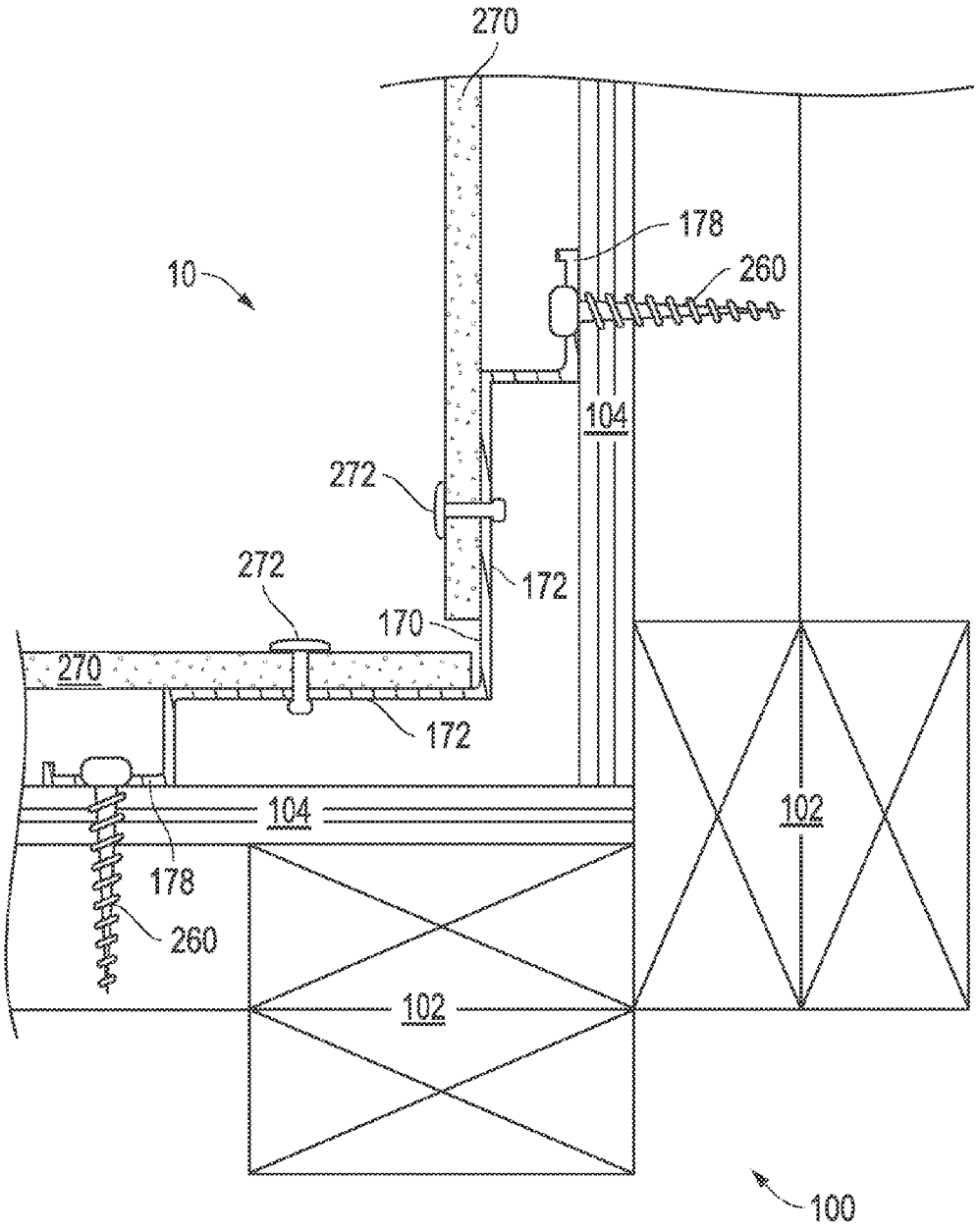
FIG. 8 is a cross-sectional, plan view of the inside corner trim exemplified as installed in a structural wall.

Referring to FIG. 8, inside corner trim 170 is exemplified securing panels of cladding 270 to a structural wall 100 that forms a corner. Wall 100 comprises studs 102 to which sheathing 104 is secured. Optionally, a water resistant barrier (not shown) may be applied to the exterior surface of sheathing 104. Inside corner trim 170 is aligned vertically such that wall-facing surfaces 180 (not shown) of flanges 178 urge against wall 100. Inside corner trim 170 is secured using fasteners 260, which are preferably self-tapping screws. Panels of cladding 270 are then secured to cladding-facing surfaces 174 (not shown) of walls 172 using fasteners 272, which are preferably rivets.

Figure 9:
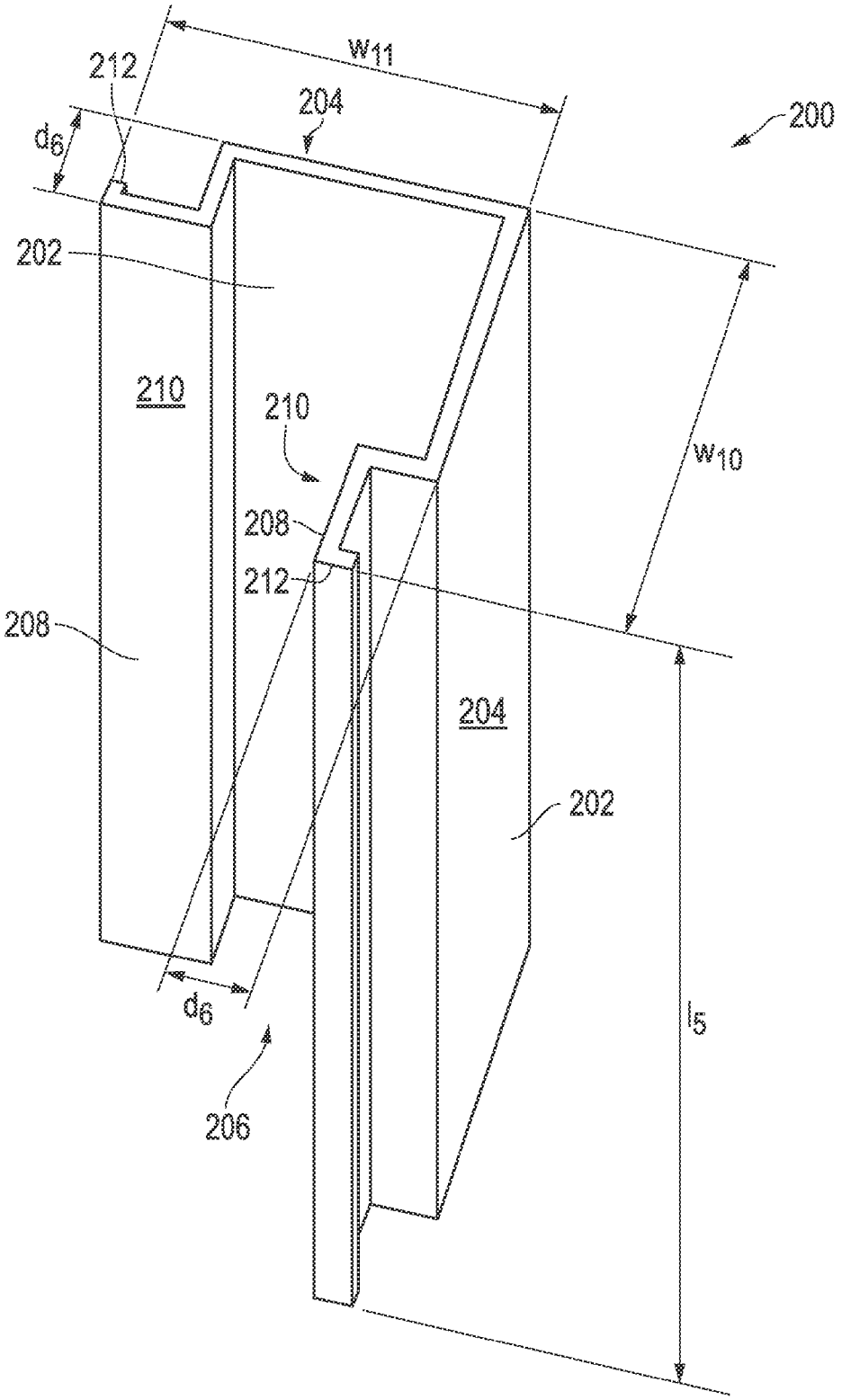
FIG. 9 is an isometric view of an outside corner trim.

Referring to FIG. 9, an isometric view of outside corner trim 200 is provided. Outside corner trim 200 comprises a pair of elongated walls 202 that are perpendicular to one another and form an L-channel 206. Each wall 202 has a cladding-facing surface 204 to which a panel of cladding may be secured. Flanges 208 are coupled to the ends of wall 202. Each flange 208 is parallel to and offset inwards towards L-channel 206 by an amount $d_6$ from its respective wall 202. Offset $d_6$ is preferably 0.875 inches. Curls 212 are formed at the ends of each flange 208. Each flange 208 has a wall-facing surface 210 for securing outside corner trim 200 to a structural wall. Outside corner trim 200 has total widths of $w_{10}$ and $w_{11}$, which are preferably 4.75 inches. Outside corner trim 200 is preferably symmetrical, but need not be. Outside corner trim 200 has a length of $l_5$. Preferably, outside corner trim 200 is manufactured to have a length of 20 feet and may be cut to a desired length during installation.

Figure 10:
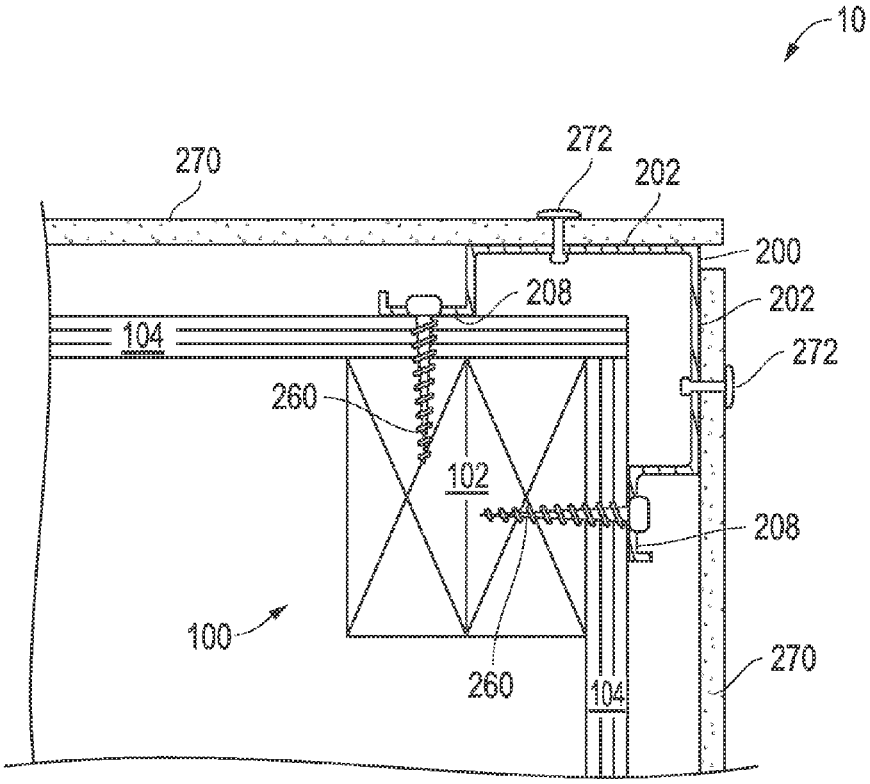
FIG. 10 is a cross-sectional, plan view of the outside corner trim exemplified as installed in a structural wall.

Referring to FIG. 10, outside corner trim 200 is exemplified securing panels of cladding 270 to a structural wall 100 that forms a corner. Wall 100 comprises stud 102 to which sheathing 104 (or dry wall, plaster board or boarding) is secured. Optionally, a water resistant barrier (not shown) may be applied to the exterior surface of sheathing 104. Outside corner trim 200 is aligned vertically such that wall-facing surfaces 210 (not shown) of flanges 208 urge against wall 100 and align with stud 202. Outside corner trim 200 is secured using fasteners 260, which are preferably self-tapping screws. Panels of cladding 270 are then secured to cladding-facing surfaces 204 (not shown) of walls 202 using fasteners 272, which are preferably rivets.

Figure 11:
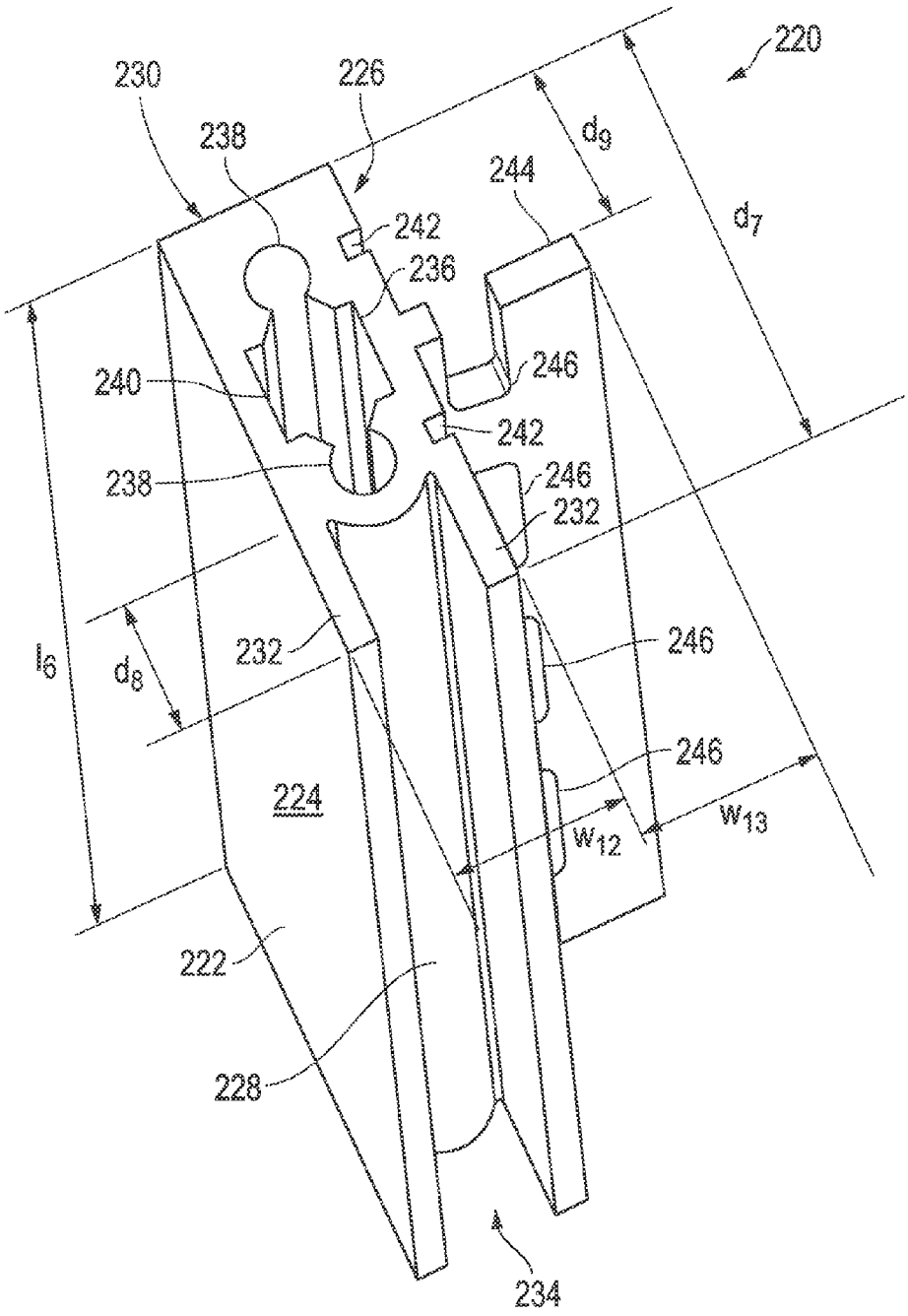
FIG. 11 is an isometric view of a window trim.

Referring to FIG. 11, an isometric view of window trim 220 is provided. Window trim 220 comprises an elongated body 222 that generally has a rectangular cross section and has a width of $w_{12}$ and a depth of $d_7$. Preferably, $w_{12}$ is 0.5 inches and $d_7$ is 1.188 inches. Body 222 has a frame-facing surface 224 and an opposite cladding-facing surface 226. Body 222 also has a wall-facing surface 228 perpendicular to frame-facing surface 224 and cladding-facing surface 226. Body 222 also has an exterior-facing surface 230 opposite the wall-facing surface 228. A pair of legs 232 is formed along the wall-facing surface 228 that define U-channel 234. The wall-facing surface 228 between legs 232 is preferably rounded. U-channel 234 has a depth of $d_8$, which is preferably 0.266 inches. U-channel 234 conserves material and also enables easier trimming to make fine adjustments to the depth of window trim 220.

Central cavity 236 is formed longitudinally through the length of body 222 and is parallel to U-channel 234. Central cavity 236 comprises a pair of cylindrical, fastener bosses 238, or more particularly screw bosses. Fastener bosses 238 provide an opening for fasteners, which are preferably self-tapping screws, which are used to assemble window trims 220 into trim-frame assembly 250 (not shown) as explained below. In addition to fastener bosses 238, central cavity 236 has a rectangular channel 240. Channel 240 reduces weight and the amount of material required. A pair of longitudinal notches 242 is formed along cladding-facing surface 226 of body 222 and run parallel to each fastener boss 238. Notches 242 provide a visual aid for identifying the location of fastener bosses 238 and also reduce material requirements.

Flange 244 protrudes outward from cladding-facing surface 226 of body 222 by an amount of $w_{13}$. Preferably, $w_{13}$ is 0.5 inches. Flange 244 is parallel to, and offset from, the exterior-facing surface 230 by a depth of $d_9$, which is preferably 0.688 inches. Perforations 246 are formed along the length of flange 244, which permit air circulation when installed and also reduce weight and material requirements. Window trim 220 has a length of $l_6$.

Figure 12A:
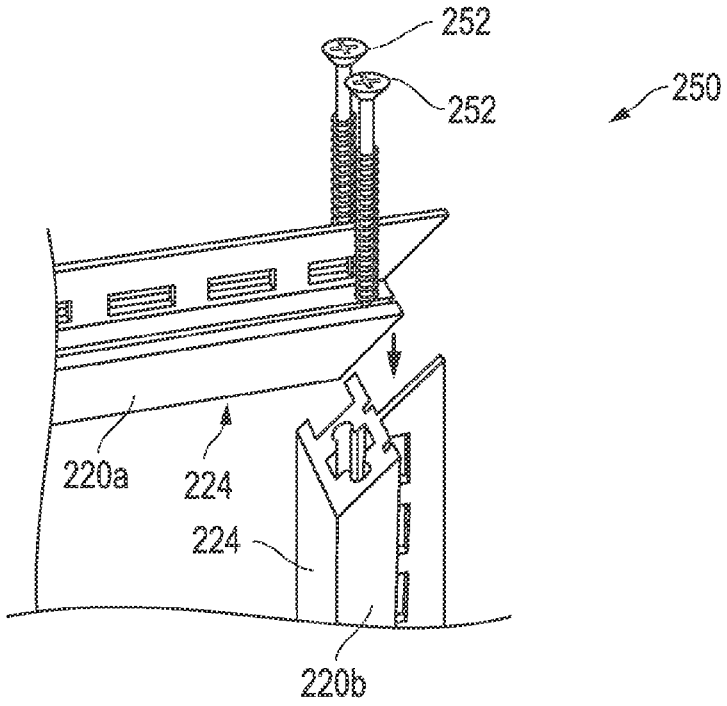
FIGS. 12A and 12B are isometric views of window trims being assembled into a trim-frame assembly.
Figure 12B:
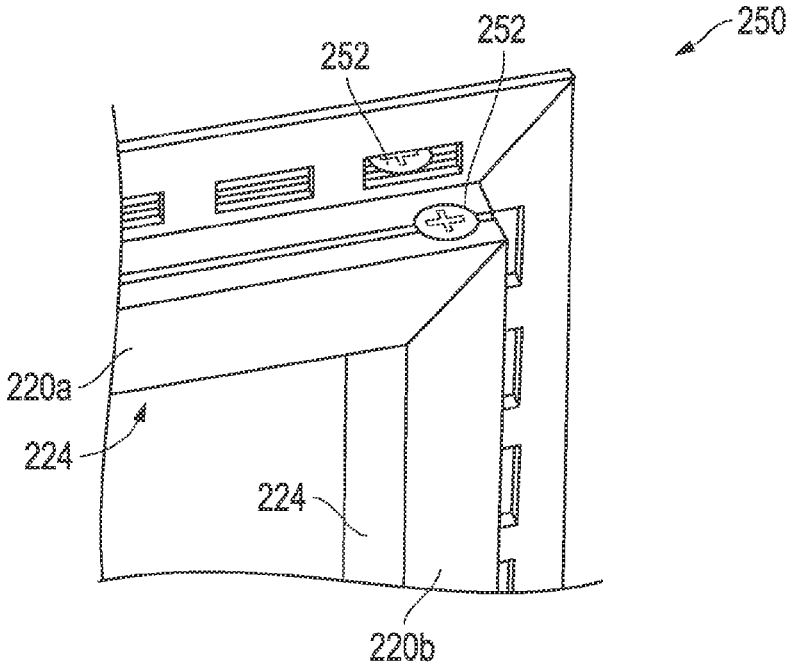

Referring to FIGS. 12A and 12B, a pair of window trims 220*a* and 220*b* is exemplified being joined together to create trim-frame assembly 250. First, window trims 220*a* and 220*b* are cut to the desired length and then the ends of each window trim 220*a* and 220*b* are cut at a 45 degree angle. The length of frame-facing surface 224 of each window trim corresponds to the exterior dimensions of a window or object that is being framed. Then, window trims 220*a* and 220*b* are brought together and fastened using fasteners 252, which are preferably self-tapping screws.

Figure 13:
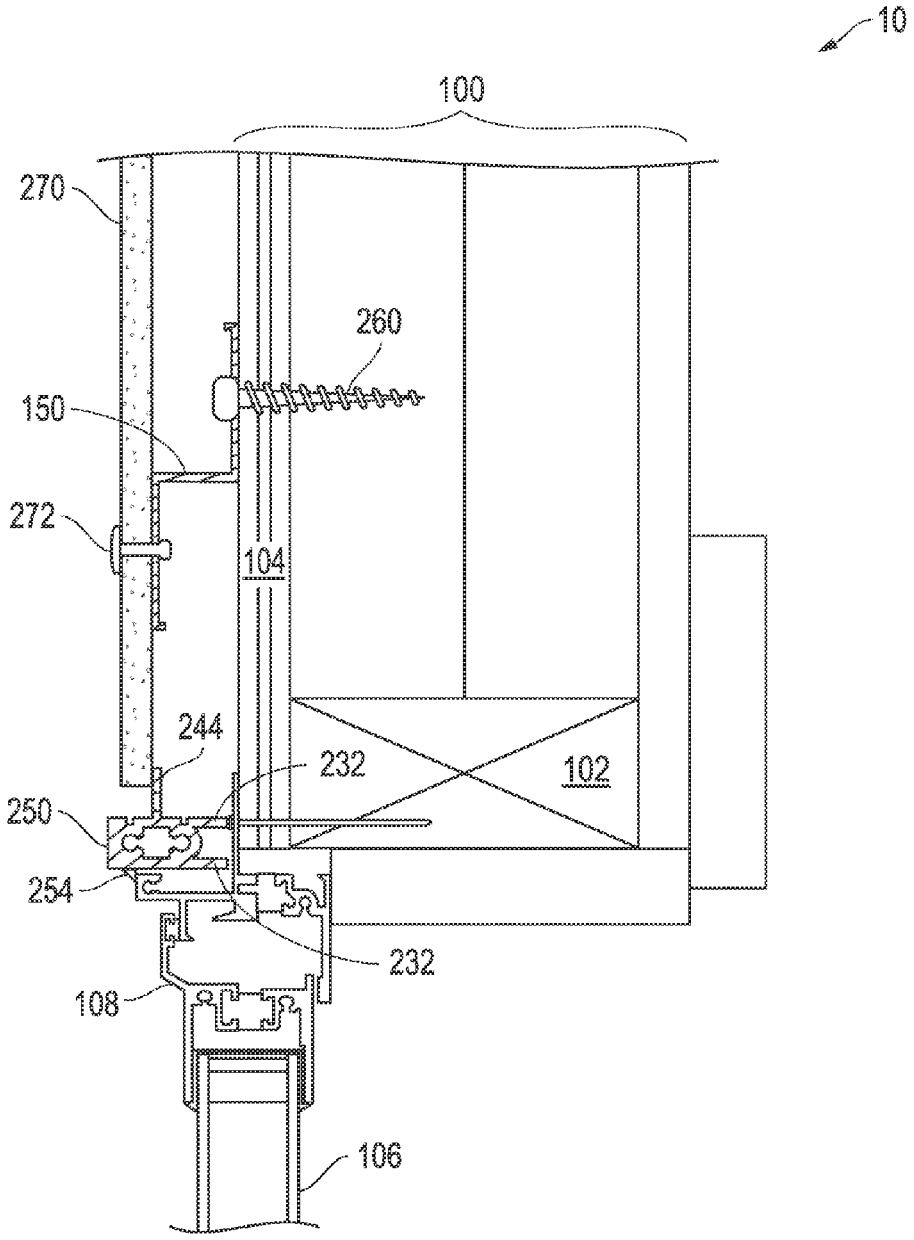
FIG. 13 is a cross-sectional, plan view of the trim-frame exemplified as installed in a structural wall.

Referring to FIG. 13, trim-frame assembly 250 is exemplified framing outside window 106, which is a nail-on window as is typically used in residential structures. Window frame 108 of window 106 is nailed to stud 102 of structural wall 100. Window trims 220 (not shown) are assembled into a trim assembly 250 as described above. Trim-frame assembly 250 is then positioned around window frame 108. Preferably, trim-frame assembly 250 has the same finish as window frame 108, which is aesthetically desirable and provides an effect that trim-frame assembly 250 is part of window frame 108. Legs 232 of trim-frame assembly 250 may be trimmed to adjust the depth of trim assembly 250. Preferably, the depth of trim-frame assembly 250 is adjusted such that the exterior surface of trim-frame assembly 250 is flush with the exterior face of cladding panels 270, which is aesthetically desirable. After adjusting the depth, panels of cladding 270 are installed. The edge of panel 270 urges against flange 244 of trim-frame assembly 250 thereby securing trim-frame assembly 250 to wall 100. No fasteners are required to secure trim-frame assembly 250 in place. Optionally, trim-frame assembly 250 may be caulked to window frame 108 using caulk 254.

It is understood that the present invention may take many forms and embodiments. Accordingly, several variations may be made in the foregoing without departing from the spirit or the scope of the invention.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A sub-framing wall system for supporting cladding attached to a wall, the sub-framing system comprising:
- a hat channel comprising:
  - an elongated planar base;
  - a pair of side walls extending upward from the base;
  - a latch extending inward from each of the side walls;
  - a cap seat extending above each of the latches and outward of each of the side walls;
  - a first and second flange extending outward of each of the cap seats; and,
  - a curl extending downward from each distal end of each of the first and second flanges; and,
- a face plate securable to the hat channel, comprising:
  - an elongated, planar body having an interior and opposite exterior surface;
  - a pair of opposing side legs extending downward from the interior surface of the body; and,
  - a strike ridge extending outward from each of the side legs.

2. The sub-framing wall system of claim 1, further comprising:
- the hat channel attached to a wall surface by fasteners that penetrate the base; and,
- wherein the fasteners attached to the base are protected from environmental conditions external to the face plate.

3. The sub-framing wall system of claim 1, further comprising:
- the hat channel attached to a wall surface by fasteners that penetrate the base; and,
- the strike ridges of the face plate engaging the latches of the hat channel to secure the face plate in compression against the cap seats of the hat channel; and,
- wherein the fasteners attached to the base are protected from environmental conditions external to the face plate.

4. The sub-framing wall system of claim 1, wherein the hat channel and face plate are made of extruded aluminum.

5. The sub-framing wall system of claim 1, wherein the hat channel and face plate are made from 11 gauge 6000 series extruded aluminum.

6. The sub-framing wall system of claim 1, further comprising:
- the hat channel secured to a wall panel by fasteners that extend through the base;
- the strike ridges of the face plate engaging the latches of the hat channel to secure the face plate in compression against the cap seats of the hat channel;
- a first panel of cladding secured to the first flange;
- a second panel of cladding secured to the second flange; and,
- the first panel adjacent to the second panel at a position over the face plate to provide a solid backing at the adjacency of the first and second panels.

7. The sub-framing wall system of claim 1, further comprising:
- an inside corner trim comprising:
  - a first wall;
  - a second wall perpendicular to the first wall to form an L-channel;
  - a first flange coupled to the first wall, the first flange parallel to, and offset from, the first wall;
  - a second flange coupled to the second wall, the second flange parallel to, and offset from, the second wall; and,
  - the first and second flanges being offset outwardly from the L-channel.

8. The sub-framing wall system of claim 1, further comprising:
- an exterior corner trim comprising:
  - a first wall;
  - a second wall perpendicular to the first wall to form an L-channel;
  - a first flange coupled to the first wall, the first flange parallel to, and offset from, the first wall;
  - a second flange coupled to the second wall, the second flange parallel to, and offset from, the second wall; and,
  - the first and second flanges being offset inwardly from the L-channel.

9. The sub-framing wall system of claim 1, further comprising:
- a Z-channel, comprising:

a central wall having a first edge and an opposite second edge;

a first flange extending perpendicularly outward from the first edge of the central wall; and, a second flange extending perpendicularly outward from the second edge of the central wall, in a direction opposite to that of the first flange.

10. The sub-framing wall system of claim 1 further comprising:

a window trim comprising:

an elongated body having a substantially rectangular cross section;

a wall-facing surface and an opposite exterior-facing surface;

a frame-facing surface perpendicular to the wall-facing and exterior-facing surfaces;

a cladding-facing surface opposite the frame-facing surface; and a pair of legs extending from the wall-facing surface to define a channel;

a longitudinal cavity formed in the body; and, a flange extending outward from the cladding-facing surface of the body, parallel to, and offset from the wall-facing and exterior-facing surfaces.

11. The sub-framing wall system of claim 10, wherein the window trim further comprising:

the longitudinal cavity having at least one fastener boss.

12. The sub-framing wall system of claim 10, wherein the window trim further comprising:

the longitudinal cavity having at least two fastener bosses.

13. The sub-framing wall system of claim 10, wherein the longitudinal cavity of the window trim further comprising:

a rectangular portion;

a circular portion on opposite ends of the rectangular portion; and, a beveled portion connecting each of the circular portions with the opposite ends of the rectangular portion; and, the circular portions receivable of a fastener.

14. The sub-framing wall system of claim 10, wherein the window trim further comprising:

perforations formed in the flange.

15. The sub-framing wall system of claim 10, wherein the window trim further comprising:

four lengths of the window trim are assembled in perpendicular relationship to form a trim-frame assembly over a window frame.

16. The sub-framing wall system of claim 1 further comprising:

the strike ridges of the face plate engaging the latches of the hat channel to secure the face plate in the cap seats of the hat channel.

17. The sub-framing wall system of claim 1, wherein the face plate further comprising:

a relief radius located between each of the side legs and the body.

18. A sub-framing wall system for supporting cladding attached to a wall, the sub-framing system comprising:

a hat channel comprising:

an elongated planar base;

a pair of side walls extending upward from the base;

a latch extending inward from each of the side walls;

a cap seat extending above each of the latches and outward of each of the side walls; and, a first and second flange extending outward of each of the cap seats; and the hat channel secured to a wall panel by fasteners extended through the base;

a face plate, comprising:

an elongated, planar body having an interior and an opposite exterior surface;

a pair of opposing side legs extending downward from the interior surface of the body; and, a strike ridge extending outward from each of the side legs;

the strike ridges engaging the latches of the hat channel to secure the face plate in compression against the cap seat of the hat channel;

a first panel of cladding secured to the first flange;

a second panel of cladding secured to the second flange; and, the first panel adjacent to the second panel at a position over the face plate.

* * * * *